US007749058B2

(12) United States Patent
Kershaw

(10) Patent No.: US 7,749,058 B2
(45) Date of Patent: Jul. 6, 2010

(54) RECURSIVE TEAM-ORIENTED CHESS-LIKE GAME FOR ENTERTAINMENT AND TRAINING

(76) Inventor: David John Kershaw, 109 Dudley Rd., Wayland, MA (US) 01778

( * ) Notice: Subject to any disclaimer, the term of this patent is extended or adjusted under 35 U.S.C. 154(b) by 505 days.

(21) Appl. No.: 11/686,712

(22) Filed: Mar. 15, 2007

(65) Prior Publication Data

US 2008/0227515 A1 Sep. 18, 2008

(51) Int. Cl.
*A63F 3/00* (2006.01)
*A63F 3/02* (2006.01)

(52) U.S. Cl. ..... 463/9; 273/236; 273/260; 463/14

(58) Field of Classification Search ..... 463/1, 463/9, 14, 15; 273/236, 241, 255, 260–262, 273/242

See application file for complete search history.

(56) References Cited

U.S. PATENT DOCUMENTS 1,207,466 A 12/1916 Baines
1,877,154 A * 9/1932 Weaver ..... 273/241
3,353,829 A 11/1967 Board
3,656,755 A 4/1972 Thompson
3,767,201 A * 10/1973 Harper et al. ..... 273/241
3,937,471 A * 2/1976 Brennan ..... 273/241
4,043,559 A 8/1977 Eigen et al.
D248,413 S 7/1978 Perfetti et al.
4,099,723 A 7/1978 Robinson
4,147,360 A 4/1979 Bailey et al.
4,184,685 A 1/1980 Wilson
D255,910 S 7/1980 Bergman
4,232,864 A 11/1980 Yaworsky
4,262,907 A 4/1981 Ginsberg et al.
4,504,060 A * 3/1985 Riihiluoma et al. ..... 273/241
4,534,565 A * 8/1985 Hube ..... 273/241
4,696,476 A 9/1987 Eplett
4,739,992 A 4/1988 May
4,778,187 A 10/1988 Deak, Jr.
4,927,157 A * 5/1990 Riihiluoma et al. ..... 273/260
D311,217 S 10/1990 Meyers et al.
5,031,917 A * 7/1991 Greene ..... 273/241
5,033,751 A * 7/1991 Ching ..... 273/241
5,035,625 A 7/1991 Munson et al.
5,108,109 A 4/1992 Leban
5,112,056 A * 5/1992 Ching ..... 273/241
5,193,813 A * 3/1993 Goff ..... 273/241
5,275,414 A * 1/1994 Stephens et al. ..... 273/261
5,338,040 A * 8/1994 Cutler ..... 273/241
5,443,268 A * 8/1995 Mayfield et al. ..... 273/241
5,556,099 A * 9/1996 Mardirosian ..... 273/241

(Continued)

*Primary Examiner*—James S. McClellan
*Assistant Examiner*—Jay Liddle

(57) ABSTRACT

This invention is a networked board game apparatus and method of playing a customized game for 2 or more players on recursively organized boards, and a method for applying the aforementioned to leadership, communications, and team building education, and further to apply the aforementioned to the specific form of Chess. Applied to form of Chess, the first board is identical to a chessboard. The second board is an 8× multiple of the first board. Tartary boards follow this exponential growth. Players alternate moving pieces to a game-ending condition. Two players lead, the next 32 players play on a second board. Each first board move changes the positions of a second board player's pieces by a uniform transformation where the first board piece's new position is a function moving the second board player's pieces, which then continue from their new positions, potentially affecting deeper levels.

1 Claim, 7 Drawing Sheets

U.S. PATENT DOCUMENTS 5,690,334 A 11/1997 Duke
5,762,503 A 6/1998 Hoo et al.
5,791,987 A 8/1998 Chen et al.
5,794,932 A * 8/1998 Gastone ..... 273/241
5,826,880 A * 10/1998 Cooper ..... 273/261
5,957,455 A 9/1999 Aldridge
6,102,399 A * 8/2000 Kifer ..... 273/261
6,120,026 A 9/2000 Whitney et al.
6,120,029 A 9/2000 Carmichael et al.
6,170,825 B1 * 1/2001 Pflum ..... 273/261
6,189,887 B1 2/2001 Dommasch
6,213,873 B1 4/2001 Gasper et al.
6,254,101 B1 7/2001 Young
6,378,871 B1 4/2002 Roberts
6,543,772 B1 * 4/2003 Bourdow ..... 273/260
6,599,128 B2 7/2003 Roberts
6,626,677 B2 9/2003 Morse et al.
6,776,414 B1 8/2004 Messac
7,007,952 B2 3/2006 Nelson
7,017,906 B1 3/2006 Benjamin
2003/0228896 A1 * 12/2003 Iida et al. ..... 463/14
2006/0279042 A1 * 12/2006 Stevenson et al. ..... 273/260
2008/0045343 A1 * 2/2008 Sauberman ..... 463/42

* cited by examiner

FIG. 5

Welcome, IMhere. This game is "Test"

- Find a game
- Find a player
- Find a team
- Start a new game
- Create a team
- Send a message
- My profile
- Home
- Help

Game details for "Test"

| | |
|---|---|
| Started? | 2007 - 02 - 11 |
| End time set? | No |
| Ended? | No |
| Requested level | Beginner |
| Teams | Red<br>Black |

| Players | Name | Role | Mail | End |
|---|---|---|---|---|
| | dpk | | ✉ | |
| | abc! | Game creator | ✉ | X |
| | IMHere | | | |
| | Sally | | ✉ | |

| | |
|---|---|
| Who can join? | Anyone may joint the game |
| Turn taking | All turns ordered |
| Turn timing | All turns time limited to 4 hours |
| Visibility | Top board sees all pieces |
| Is delegation allowed? | No delegation |

RECURSIVE TEAM-ORIENTED CHESS-LIKE GAME FOR ENTERTAINMENT AND TRAINING

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The game of chess has inspired many versions, including a few which are educational in nature. Many other types of educational games exist, some of which focus on team building and group leadership. In the scope of team building games, leadership development games, and similar educational entertainments, a significant minority are either board games or electronic games. Chess itself is sometimes referred to as an educational game with its traditional objective being to teach strategic thinking.

A notable example of an educational networked group game for the teaching of, inter alia, cooperative group behavior is the US Department of Defense's America's Army. America's Army is a first person shooter type game wherein players take on the roles of Army soldiers and may work in small teams to overcome challenges in training and fighting. Game visuals are as realistic as possible, as are the tools, physics and other attributes and instruments of the game. The game is used as a promotional and training tool both within and outside the Army.

Another example of an educational networked group game used in the business and academic worlds is Enlight Software's Capitalism II. Capitalism II is used by business schools and corporations to teach strategic and tactical business thinking. The game attempts to provide a realistic business environment, including visuals such as maps, views of cities, etc. The goal of the game is to create a corporation that controls its market, is profitable, and has a worldwide reach.

Chess is referred to as an abstract game. In the field of abstract games, there are significant minorities that include aspects of team play, multiple boards, more then 2 dimensions, timed turns, or other similarities to the present invention. Many abstract games are played in electronic or networked form.

There are several drawbacks to the specifically educational games and simulations developed for team building, group learning and leadership development described above. The present invention attempts to improve on the state of the art by addressing the following main problem areas.

First, the more recent such games, for instance America's Army and Capitalism II mentioned above, are layered in detail and attempted realism to the degree that players are distracted from the nature of the educational goal by visceral reactions to the game play, and therefore more likely to receive training in short term, reactive, tactical skills. The tactical lessons learned will be most useful in very specific circumstances. They are much less likely to represent a change in typical behavior or a learned general response to various general circumstances.

Second, many educational games built on either a basic framework such as Chess, or a more modern video game approach, are complex to learn, or have enough intrinsic learning required for successful play that the learning derived from the play is reduced to a secondary status.

Third, virtually all board and video games with team oriented educational content are focused on a single level of a hierarchy, or remove hierarchy from the game. In life, hierarchy is ever present in the form of management, ownership, chain of command, etc. Groups in business and military contexts are particularly prone to complex interactions between members of the group which are strongly influenced by positions within a hierarchy. While some non-board, board, and video games do attempt to take social hierarchy into account, typically the hierarchical relationships are either thin or virtual and unrelated to the connections between actual players, especially where those players are not in opposition to each other. Hierarchy is rarely, if ever, expressed as a hierarchical relationship between current players where one player's decisions and actions act on players of the same group playing at a lower level. In most cases, to the detriment of realistic learning, hierarchy is actively minimized or abstracted from one player having real impact on other non-oppositional players, typically to alleviate an aspect seen as a distraction or obstacle to smooth group functioning and game play, rather then addressing the immediate interpersonal hierarchy as a reality to be practiced and managed.

Forth, while educational games come in all shapes, sizes, speeds, and durations of play, a dichotomy predominates where mission oriented games tend towards being single-sitting and finite objective, whereas open-ended games tend to simulate the unconstrained aspect of real life rather then structure play within constraints. This separation forces educators to choose between games, rather then offering a configurable game that permits immediate tactical learning, long-term play with a single objective as self-reinforcing strategic learning, observational simulation style learning where immediate play is only indirectly connected to specific outcomes, or a combination of these.

While not exhaustive, the following listing of patents as prior art attempts to highlight those inventions that are most representative of their type and that have aspects similar to the present invention.

U.S. Pat. No. 6,902,481 to Robert E. Breckner, Greg A. Schlottmann, Nicole M. Beaulieu, Steven G. LeMay, Dwayne R. Nelson, Johnny Palchetti and Jamal Benbrahim for a game platform that separates the presentation of a game from its underlying logic such that at the user level games may be easily varied.

U.S. Pat. No. 6,786,825 to Akitoshi Kawazu for a game that is configured with an initial controlling value which affects how the game is played.

U.S. Pat. No. 0,511,773 to Frederick A. Iiiggins for a chess-like game with abstract pieces of shapes to be defined by the players on a larger then standard chess board comprised of smaller sections of squares.

U.S. Pat. No. 4,778,187 to Joseph W. Deak, Jr. for a modified game of chess primarily differing from standard chess by the configuration of an expanded board.

U.S. Pat. No. 4,147,360 to Joseph W. Deak, Jr. for a 4 player chess-like game on a larger then standard board and with additional pieces.

U.S. Pat. No. 3,843,130 to Karl R. Whitney for an expanded game of chess for up to 4 players.

U.S. Pat. No. 5,586,762 to Jon P. Wearley for an abstract game based on a nonstandard board, with respect to the standard chess or checkers boards, which may be rule-customized to be akin to either chess or checkers.

U.S. Pat. No. 4,856,789 to Richard A. Carlson for a chess-like game for teams of two on a nonstandard board with additional pieces.

U.S. Pat. No. 4,708,349 to Dan Shomer for a chess-like game which may be played by a varying number of players up to 4 on a nonstandard board and new rules of play.

U.S. Pat. No. 6,799,763 to Brian Grady for a chess-like game on a nonstandard board.

U.S. Pat. No. 3,840,237 to Steven Shkolnik for a chess-like game for 3 players making use of multiple sets of chessmen and extending play across multiple boards.

U.S. Pat. No. 3,829,099 to Ronald Ray Lucero for a 4 player chess-like game.

U.S. Pat. No. 4,021,043 to Ronald Ray Lucero for an educational chess game focused on teaching chess using a modified board played by up to 4 players, and having an end game state which is negotiated prior to play.

U.S. Pat. No. 6,446,966 to Henri Crozier for a simplified chess-like game on a modified board with a point-based scoring system, and which may be adapted for networked play.

U.S. Pat. No. 5,421,582 to Carl E. Ritter for an expanded game of chess wherein a nonstandard board and new pieces are used.

U.S. Pat. No. 5,690,334 to George William Duke for a modified game of chess using an expanded board and additional pieces.

U.S. Pat. No. 5,957,455 to Chester P. Aldridge for a game of chess wherein the pieces of an opponent are hidden from view.

U.S. Pat. No. 3,353,829 to Richard G. Board for a combat game on multiple boards wherein structures are used to shield boards from complete viewing by players, and which provide 3 dimensional display.

U.S. Pat. No. 6,120,026 to Leland R. Whitney, Myron K. Jordan, Thomas J. Scanlan, and Gregory D. Allen for a board game enhancement comprising a privacy screen which limits the view of a player based on position to a portion of play, and potential new rules and configurations of existing board games.

U.S. Pat. No. 7,017,906 to Gregory Benjamin for a board game as in checkers or chess, but with the addition of mirrors placed such that they modify by reversal the apparent positions of either a players own pieces or his or her opponent's pieces.

U.S. Pat. No. 4,232,864 to James J. Yaworsky for a multi-level game wherein the upper board is translucent and permits a varying field of play and varying views of the lower board.

U.S. Pat. No. 5,031,917 to Leonard M. Greene for a 3 dimensional chess game using 8 chessboards which may be stacked or laid out adjacent to one another, and on which play a modified number of chessmen that can move horizontally or vertically.

U.S. Pat. No. D,255,910 to Michael D. Bergman for a specifically depth limited multi-level chess game wherein each successively lower level is larger then the last by a regular amount.

U.S. Pat. No. D,311,217 to Christine E. Meyers and Glenn M. Meyers for a multi-tier board game of which each successively lower board is larger then the last by a regular amount.

U.S. Pat. No. 3,656,755 to Robert I. Thompson for a 3 dimensional checkers game comprising multiple boards, each based on the standard board design but differently shaped, spaced vertically.

U.S. Pat. No. 4,184,685 to David A. D. J. Wilson for a 3 dimensional board game played on two levels with pieces which travel between levels.

U.S. Pat. No. 6,776,414 to Paule Messac for a universal game board on which may be played a wide variety of games under varying configurations of the board and pieces.

U.S. Pat. No. 5,108,109 to Bruce P. Leban for a board game wherein board sections are composed of subsections, on which are placed pieces, which may connect to other subsections in a variety of ways depending on how players position the sections during play. In addition a method for concluding a game based on a pre-negotiated definition of what the end game state looks like.

U.S. Pat. No. 6,599,128 to Ronald J. Roberts for a game with the intent to teach strategic thinking and which can be miniaturized to fit on a board.

U.S. Pat. No. 6,378,871 to Ronald J. Roberts for a team game, wherein one player is the team leader, which teaches the value of communication, creative thinking, leadership, teamwork, and cooperation.

U.S. Pat. No. 6,254,101 to Jason Phillips Young for a floor game teaching team building skills wherein some players have the ability, via a device, to see geometric paths on the surface of the floor while other players can not see the same.

U.S. Pat. No. 5,762,503 to Joel Hoo and Toshi A. Hoo for a set of electronic components for use both in a game and as an executive management training or team building exercise.

U.S. Pat. No. 6,626,677 to Stuart H. Morse and Stacey A. Morse for a method of teaching leadership, communications and team building skills in an activity.

U.S. Pat. No. 7,007,952 to Christine Nelson for a game which can be used as the basis for developing, inter alia, leadership skills in players.

U.S. Pat. No. 5,035,625 to Gerald L. Munson, Edward P. Daniels, Jr., and Joseph D. Mallozzi for an educational question and answer style game played on a computer.

U.S. Pat. No. 6,213,873 to Elon J. Gasper, Thomas M. Abbott, and John G. Gilmore for a computer chess game that helps teach chess strategy, and by analogy general strategy.

U.S. Pat. No. 5,791,987 to Huai-Yen Fred Chen, Wen-Kang Andrew Li, and Yu-Ying Anita Liang for a chess style game played on a computer.

U.S. Pat. No. 4,099,723 to Harry G. Strappello for a nested set of board rings together comprising a single 3 dimensional chess-style board for playing games of chess, checkers, etc. under the normal rules of the game.

U.S. Pat. No. 4,696,476 to Gene W. Eplett for a game board apparatus which has multiple stepped levels for playing chess or checkers or like games.

U.S. Pat. No. 6,189,887 to Daniel A. Dommasch for a game played by 2 or more players on a board with multiple playing regions, and wherein a player's pieces may go in and out of play based on the moves of the other players.

U.S. Pat. No. 4,043,559 to Manfred Eigen and Winkler, Ruthild for an educational game apparatus composed of multiple levels capable of playing a set of games for teaching statistics.

U.S. Pat. No. 4,739,992 to Richard W. May for a game played on a reversible board wherein the sides of the board have a well-defined relationship to each other and one side is chosen for play based on the desired difficulty.

U.S. Pat. No. 6,120,029 to Craig G. Carmichael, and Brian Lee Boyd for an educational chess-like game which is capable of teaching standard chess as well as a game derived wherefrom.

U.S. Pat. No. 5,275,414 to Ryan K. Stephens, Christopher L. Zeis, Ronald R. Plew, and Robert E. Mattsey for a Chess-like game played by 2 teams of 2 players on a modified chessboard.

U.S. Pat. No. 1,207,466 to J. B. Baines for a board game played by 2 to 4 players which affords a mental exercise sufficient to help concentrate the mind, but which remains a pleasant pastime.

U.S. Pat. No. 4,262,907 to Allen Ginsberg, Martin F. Huss, and Joseph Lynn which provides for a game of a general type which may be adapted to certain types of competition which are encountered in everyday life.

U.S. Pat. No. D,248,413 to Theodore Perfetti, Benedetto Greco, Burton Heiko for an adaptation of checkers to teams of players.

BRIEF SUMMARY OF THE INVENTION

This invention is a networked board game apparatus and method of playing. The method applies the aforementioned game apparatus to the educational objectives of leadership development, group communications, collaboration, and team building. The preferred embodiment of the invention is a specialization of the game apparatus to the form of Chess to produce a unique variant on that game.

The game apparatus is primarily composed of a set of recursively organized boards, pieces that are played on these boards, and the subsystems modeling and organizing the participating work groups whose purpose in playing the game is to learn skills they will continue to use in their corporate setting after the learning session is complete. These subsystems include tools supporting the creation, customization, playing and scoring of games, and the subsystems supporting the assembly, management, and communications with and between players. The recursive organization of the game boards is evidenced by each segment of an upper board, called the Top Board, representing an area of the next lower board that is identical to the whole of the board that section is a member of. Applied to the form of Chess, the topmost board is identical to a chessboard. The second board, called the Lower Board, is an 8× multiple of the first board. Tertiary boards, if any, follow this exponential growth pattern. At the option of the players or of the maker of the embodiment of the invention, the apparatus may be limited to two levels, or alternatively more levels, limited only by available computing and network resources, and available players.

The method of playing requires a minimum of two players, and is upwardly limited only by computing and network resources, to play a specifically customized instance of the game until a game ending condition set prior to the start of play is reached. During the configuration of a game, prior to the start of play, a game creator must determine the following points of configuration:

1. The form of the game board
2. The number of levels, if more then two are supported by the particular embodiment of the game apparatus
3. The types of pieces that will be played, including their possible movements
4. The number of pieces that each player will play
5. The game ending condition
6. The game starting condition
7. The ordering of turns on the different boards
8. The timing of turns on the different boards
9. The effect of capturing a piece with regards to the superior and inferior playing boards
10. The visibility of the game boards allowed to players playing on different boards
11. The method of scoring the game according to the pieces captured
12. The players of the total population who may join the game
13. The ability, or lack thereof, for players to delegate turns to other players
14. The turns that are to be routinely, but temporarily, skipped in each round at the start of play
15. The means of collaboration between the players of a team The method of playing further requires that two players playing on the topmost board lead the game. The next 32 players play on the Lower Board. At each additional level the number of possible players is the square of the level above. As regards turn-taking, visibility, effect of moves, turn-timing and ordering, and pieces every pair of boards behaves as a Top Board and a Lower Board.

Each Top Board move changes the positions of the set of a Lower Board player's pieces automatically by a uniform transformation wherein the Top Board piece's new position acts as a function which moves all of the Lower Board player's pieces to new positions on the Lower Board. The Lower Board player takes his or her next turn by moving one of his or her pieces from its new position. Moves by Lower Board players have no effect on their Top Board player's pieces.

As in a game of Chess one side moves first, then the other and so on. Within a team turns are taken according to the turn taking scheme determined by the game creator prior to game start, but all turn taking schemes are at minimum ordered by turns taken on the Top Board. The range of turn taking schemes is between a complete ordering of all members of a team interspersed by all members of the opposing team, to any or all members of each team moving within the time taken by their Top Board player to move.

In the preferred embodiment the pieces are taken from Chess. Each of the pieces carry the same move and capture capability as in Chess, but with caveat that on the exponentially larger Lower Board those pieces that may travel to the extent of the Chess board may find themselves able to travel much farther. Lower Board pieces moved automatically when the Top Board player moves their representing piece may be widely dispersed, rather than centered on the area of the Lower Board analogous to the Top Board square containing the piece moved. This spatial and tactical complexity is the primary challenge used by the game to motivate communication and collaborative work through the subsystems provided for communication, tracking and coordinated action.

The present invention addresses the several drawbacks to the educational games and simulations developed for team building, group learning and leadership development described above.

The present invention addresses the first problem of the trade-off between detail and broadly applicable learning by taking the sophisticated group play, fast pace, and team creation opportunities inherent in a networked educational video game and applying them to an abstract game where the focus is shifted primarily to interpersonal relationships due to the conceptually and visually minimal play, the constraining framework of the game, and the removal of much rote content of a well known strategic board game like Chess by the addition of dimensions of play which are significantly different to, and not viably playable as, a physical game of Chess, or similar board game.

The present invention addresses the second problem of the trade-off between effort to learn and actual learning from play by pushing much of the complexity of the game into a pre-game configuration process, possibly an educational negotiation in itself, and keeping at least the Top board completely familiar in form to Chess players, but removing the tactical context of Chess, e.g. the opening move catalog, known endgames, etc, by forcing attention down to the second order impact of each move on the Lower Board, and on the information sharing that necessarily happens between players of a successful team.

The present invention further addresses this problem by offering the opportunity to create simplified forms of the game, e.g. with fewer pieces, fewer piece types, smaller board, fewer levels, etc. Or, alternatively, by providing a look and feel that more closely matches games the player is familiar with, while keeping the abstract underlying structures, rules, and overall game type described herein by configuration of the game in a simple user interface. As a concrete example, the present invention has been successfully played on configuration that includes a 6×6 sectioned Top Board with 3 piece types borrowed from Chess: the Queen the Pawn, and the Bishop, and in other respects followed the form of Chess within the context of the framework described in the present invention.

The present invention addresses the third problem of the absence of practical and educationally used hierarchy within the game playing experience by putting hierarchy at the forefront of game play so that one or more players have direct control over the circumstances of other players on their team and must make decisions with difficult to foresee and possibly negatively impact on teammates without those individuals necessarily knowing the reason for the action. This is done with the intent to mirror the real life problems of multiple levels of hierarchy with regards to communication, leadership, decision making, negotiation, and cooperation, and to force players to address and practice handling that reality in an abstract venue that is generalizable to a range of work or command situations.

The present invention addresses the forth problem of the limited specific educational target of games by requiring a game creator to specifically configure games by pace, duration, sequencing, visibility, impact of captures, and other aspects which result in a game instance that meets one of a broad range of educationally useful forms. This results in a game that meets the particular need, whether that be to illustrate a specific scenario, offer repeated reinforcement complementing a long term educational or noneducational project, observe the cascading effects of behaviors on indirectly related players, or another similar educational goal. Moreover, the game's configurability, in combination with the abstract domain, permits the educator to better simply compress or expand learning to fit a set time table, if needed.

BRIEF DESCRIPTION OF THE SEVERAL VIEWS OF THE DRAWING

FIG. 5 is a view of a selected subset of a game instance configuration interface at the time of a game instance's creation but after the board and piece types are set

DETAILED DESCRIPTION OF THE INVENTION

Figure 1:
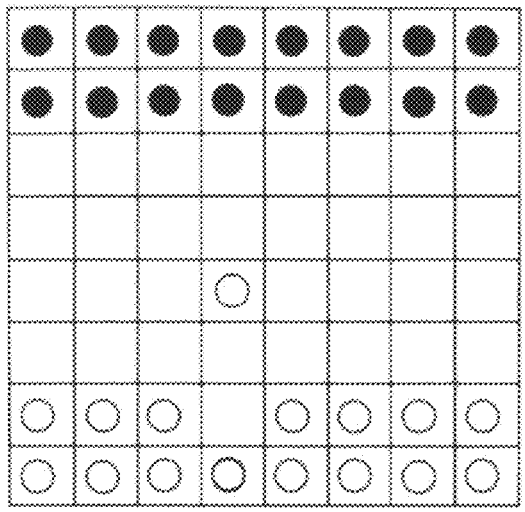
FIG. 1 is a top view of the Top Board after one move of play in a game configured identically to chess with regards to Top Board and piece types
Figure 2:
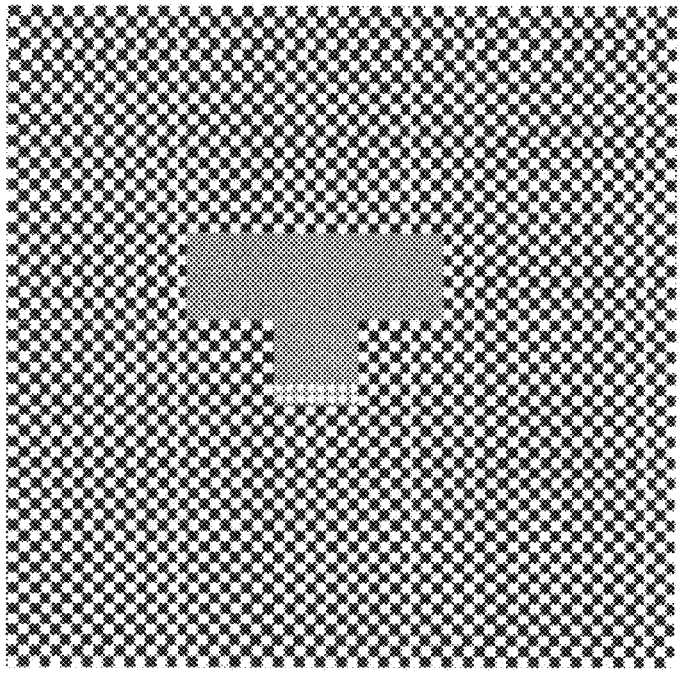
FIG. 2 is a top view of the Overview Board of the same game instance after one move of play
Figure 3:
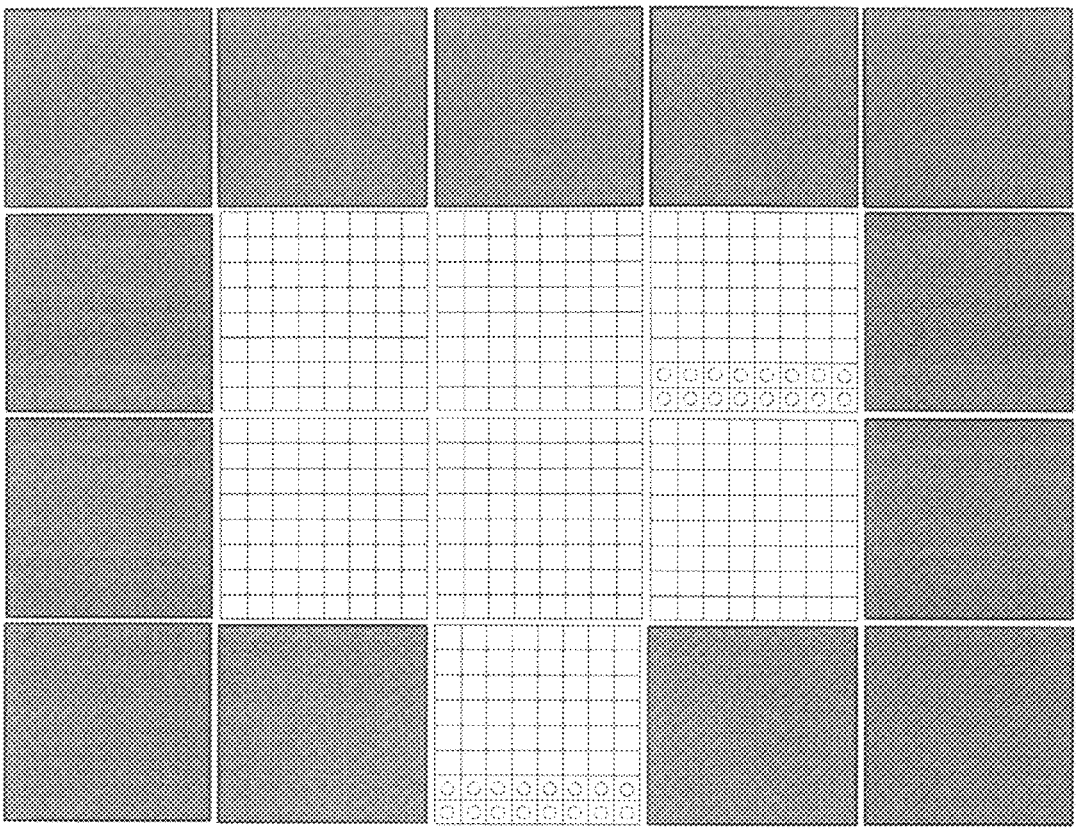
FIG. 3 is a partial top view of the Lower Board of the same game instance after one move of play
Figure 4:
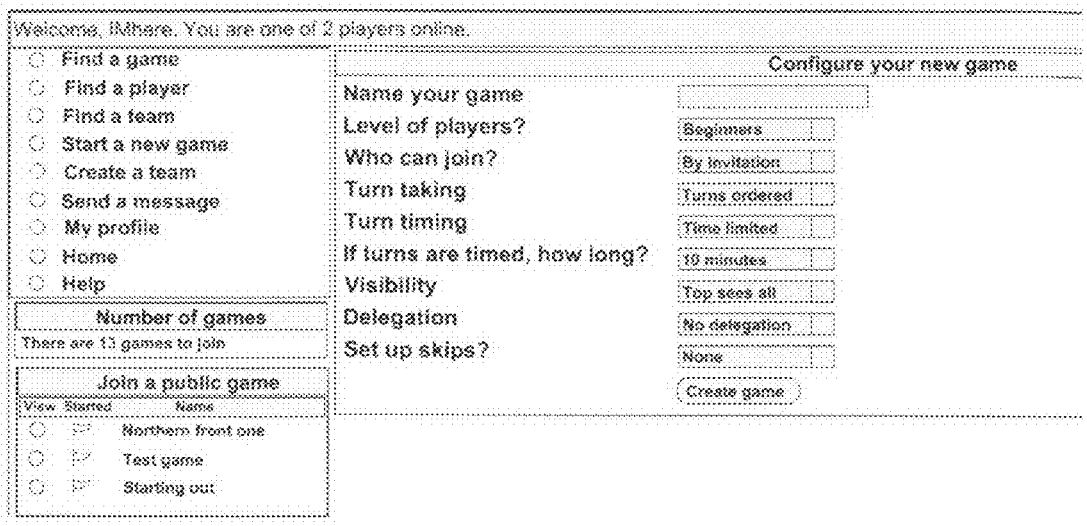
FIG. 4 is a view of the first form in a series of new game creation steps
Figure 6:
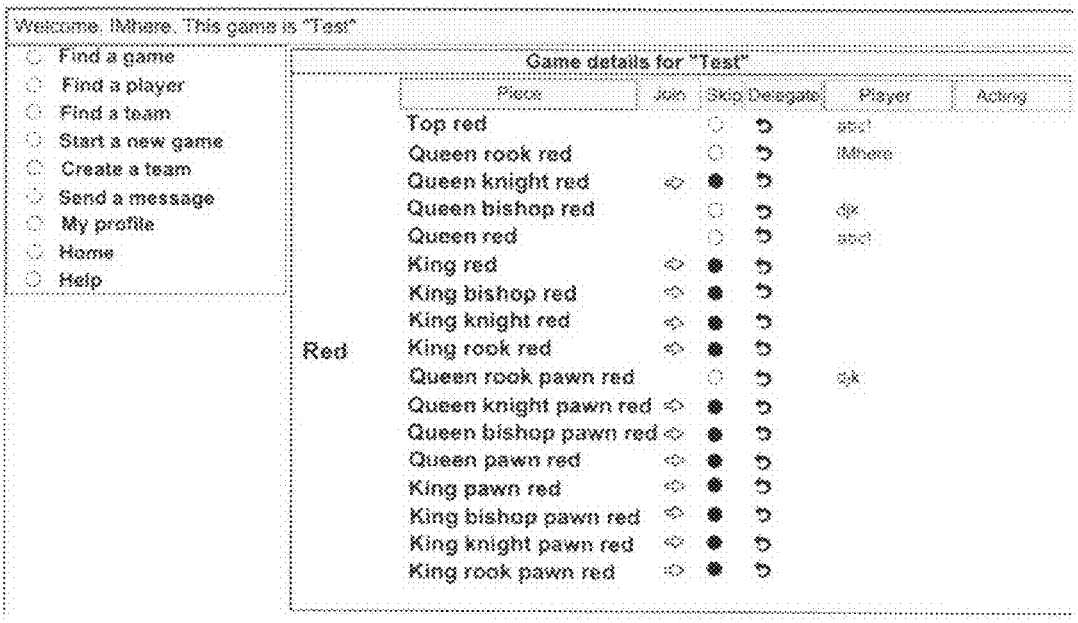
FIG. 6 is a view of the game instance join user interface, showing the representative pieces a player may sign up to play
Figure 7:
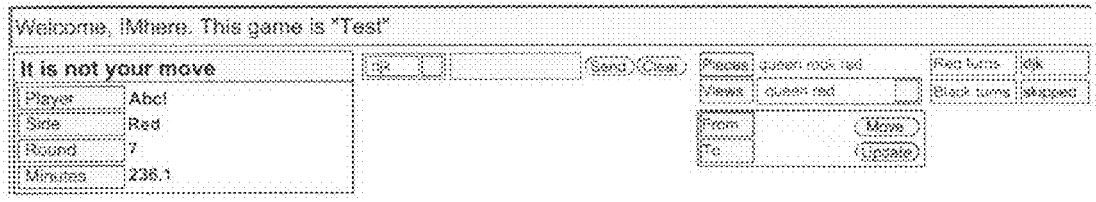
FIG. 7 is a view of a selected subset of game instance's controls as they might appear to a player during play
Figure 8:
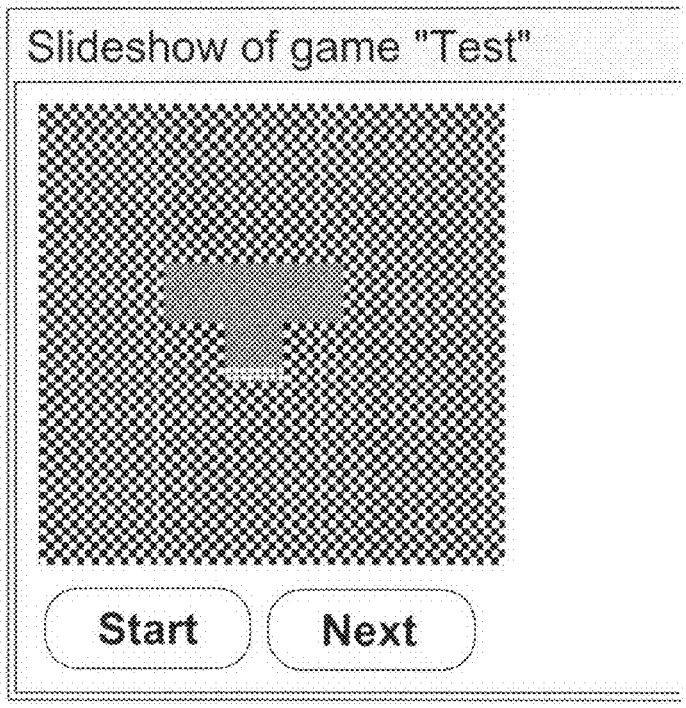
FIG. 8 is a view of the game review interface showing the Overview Board after one move of play
Figure 9:
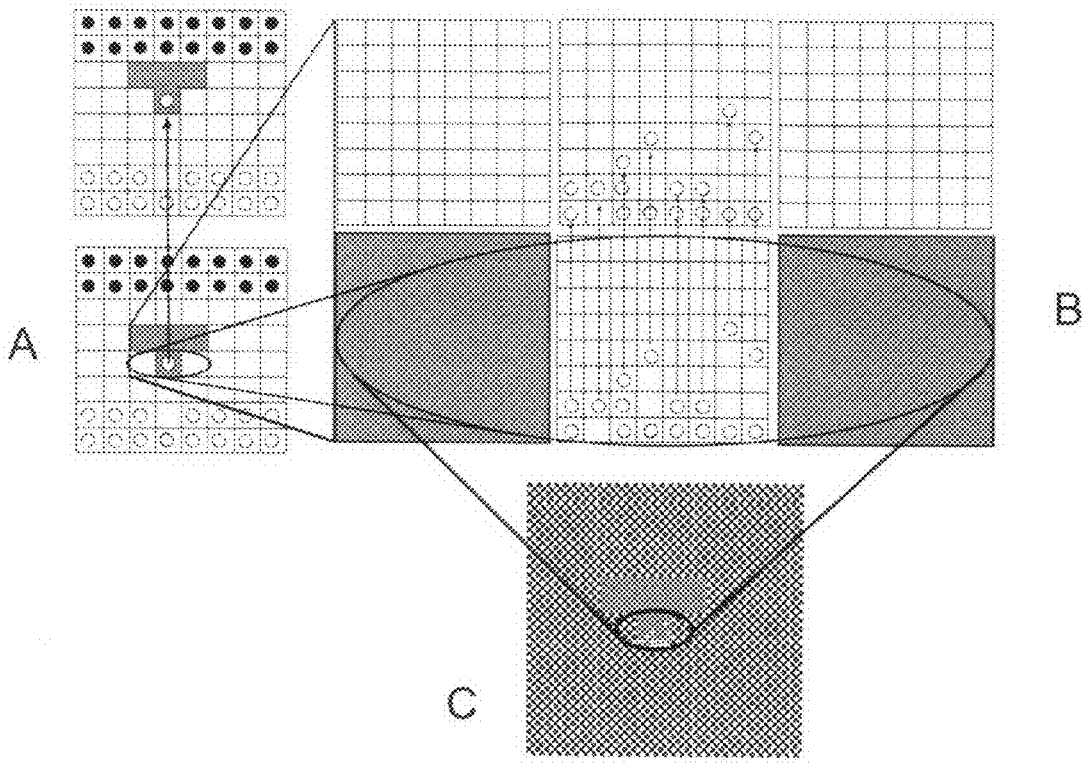
FIG. 9 shows the automatic movement of a Lower Board player's pieces when The Top Board player moves the Lower Board player's Representing Piece, a white pawn, forward one square; where A is the Top Board view, B is the Lower Board view and C is the Overview Board view

The present invention is a Chess-like game and the collaborative environment supporting the game which simulates more complex real-world teamwork situations (e.g. chain of command during battle, group cooperation in the execution of a business project, etc.) The game uses simple rules to guide and constrain group activity so that actions taken by team members impact the success of the group's play versus another team over a short time period in an abstract and enjoyable venue while illustrating in an instructive sense the effects of teamwork, management style and communication. The invention is used in structured (e.g. training class) or unstructured (e.g. individual playing primarily for enjoyment or practice) circumstances to improve team building, management and group communications, collaboration, and leadership skills.

The present invention relates to an online (i.e. networked) apparatus for collecting groups of players, configuring an instance of the game that is specialized to the skill level and experience of the players, and to the instructive or entertainment goals for the particular game, not dissimilar in form to other electronic games, Web applications, and training software, but with the specific intent and functions of supporting the training and entertainment objectives of the Chess-like game at its center.

The present invention further relates to the apparatus used in hosting the chess-type game. Each game is stored on a network server and played within a Web application. Players create accounts and once logged into their account they may create a game, join a game or otherwise communicate through messages and actions with other users of the application, as is typical for multi-user workgroup Web applications.

The overall form of the game is that of a two or more level set of Chess-like playing boards. In concept the boards are hierarchical; however, they need not be spatially superior and inferior in a physical embodiment, nor in the preferred networked software embodiment are the boards shown in a hierarchical or cascading view. Logically the smallest board is the controlling board, called the Top Board. The next board. most dependent on the Top Board. called the Lower Board, is sized to be the square of the Top Board. In the preferred embodiment the Top Board may be set to be 8×8 squares, and in that case its Lower Board is 64×64 squares. Any further boards are likewise exponentially larger than the board before. Each pair of boards has the same relationship one to another as the Top Board and its Lower Board, and are likewise referred to using these names. Each Lower Board indicates its squares in two ways, as individual squares of alternating color, and as sets of squares that indicate a position on the Top Board. So in an 8×8 Top Board game the Lower Board would be 64×64, but also clearly mark out 8×8 sections corresponding to the squares of the Top Board.

Every game must have at least two players who play on the Top Board. Each successive board that is played must have the same number of players as there are pieces on its Top Board. So for instance, in an 8×8 Top Board game with 16 pieces per player there are two players on the Top Board and 32 players on the Lower Board. In games where there are too few players available some players may be assigned multiple turns. Each of the players on the Lower Board plays the same number and type of pieces as are played on the smallest board, the top Top Board.

Each player on a Lower Board has a specific piece that represents him or her on the Top Board, called their Representing Piece. The Lower Board player does not play their Representing Piece. When the Top Board player moves the Representing Piece, all of the Lower Board player's pieces are automatically moved en mass in a uniform transformation. The movement applied to each Lower Board player's piece is the same number of squares as is moved by the Representing Piece multiplied by the factor the Lower Board is larger than the Top Board. So if in an 8×8 game a pawn is moved one square, the Lower Board player represented by the pawn will see all of their pieces automatically moved eight squares in the same direction their Representing Piece moved. The wholesale change in position of the Lower Board player's pieces changes the strategic circumstances of that player vis-á-vis the opposing team, as well as vis-á-vis other Lower Board players on the same team. Once the Top Board move has been made, turn-taking progresses either to the opposing Top Board player, or to a Lower Board player, according to the game's configuration and the specific point of game play.

By default, but subject to per game configuration, Top Board players do not have a direct view of the Lower Board and Lower Board players do not have any view of the Top Board or any complete view of the Lower Board. Every Lower Board player views the Lower Board according to the freedom of movement of their Representing Piece's type on the Top Board and according to the squares that their Representing Piece may actually move to at any given moment. The Lower Board players begin in an area of the Lower Board exactly equal to the Top Board and positioned on the Lower Board in the section of squares corresponding to the square on the Top Board where their Representing Piece begins, called the Home Area. The Lower Board player's set of pieces begin in exactly the same positions as those of the Top Board player. Once moves are in progress, each Lower Board player's view expands from their Home Area to include all of the Lower Board squares corresponding to the Top Board squares their Representing Piece may move to. So for example, in an 8×8 Top Board game, a Top Board pawn that may move one square forward, or capture one square diagonally forward, affords the Lower Board player represented a Home Area of 8×8, plus an 8×8 area forward of the Home Area, plus two 8×8 areas beginning on the $9^{th}$ rank from the back of the Home Area and on the $9^{th}$ file to the right and the -1st file to the left of the home area. These squares constituting the entire area corresponding to the one square starting position of the Representing Piece, and its three possible destination squares. A Representing Piece with a greater degree of possible movement, such as a rook, might allow the Lower Board player represented a considerably larger playing field than the example pawn confers, and that playing field would change size more dramatically as the Top Board game progresses.

The present invention uses the same concept of capturing as in Chess. Subject to configurations outlined below, when a player moves his or her piece to a square occupied by a piece of the opposing team the opposing team piece is removed from the board and accounted as capture. The goal of the players is to capture the opposing pieces. In the preferred embodiment the pieces take the form of Chess pieces and their captures are accounted in the familiar way.

Prior to the start of play a game instance is created and configured to differ from a default game-play rule set by restriction. The rule set has 15 axes that may be configured with schemes appropriate to the needs and goals of the instructor, or the players. which are:

1. The form of the game board
2. The number of levels, if more then two are supported by the particular embodiment of the game apparatus
3. The types of pieces that will be played, including their possible movements
4. The number of pieces that each player will play
5. The game ending condition
6. The game starting condition
7. The ordering of turns on the different boards
8. The timing of turns on the different boards
9. The effect of capturing a piece with regards to the superior and inferior playing boards
10. The visibility of the game boards allowed to players playing on different boards
11. The method of scoring the game according to the pieces captured
12. The players of the total population who may join the game
13. The ability, or lack thereof, for players to delegate turns to other players
14. The turns that are to be routinely, but temporarily, skipped in each round at the start of play
15. The means of collaboration between the players of a team In the preferred embodiment, the decisions on each axis of configuration are entered into a set of Web forms navigated using a standard Web browser, as is common practice in Web applications. The mechanism for storing the configuration is a simple online database. Any available configuration may be left in a default state or set explicitly by the game creator.

In the first configuration axis the form of the Top Board is selected. In the preferred embodiment the likeness is to the Chess board and the choices are between a standard 8×8 oard or a board with a smaller number of squares. Fewer squares on the Top Board require fewer players playing on the Lower Board.

In the next configuration axis the game creator chooses the number of boards, and thereby the number of players. Each board is considered a level, in keeping with the hierarchical concept of the game. Every pair of boards acts as a Top Board and a Lower Board. For every board beyond the first Lower Board the number of possible players increases exponentially.

In the next two configuration axes the game creator selects the number of pieces and the piece rules of play. Any game, regardless the size of board, may contain its own set of pieces and define the moves of those pieces. For example; in a 6×6 game following the form of Chess the game creator may decide that there will be no King and no Bishop. Further, a rule of play in standard Chess for the piece type of rook is that a rook may move horizontally or vertically in any non-diagonal straight line from the square of origin, unless blocked by a same side piece or by a capture opportunity; however, the game creator may decide to limit the number of squares traveled by a rook to, for example, three in order to optimize the use of the smaller board. The present invention permits a game creator to set the number of piece types, the number of total pieces, and the piece rules of play for each type, prior to play.

Because the game at the center of the present invention may accommodate a large number of participants, it may also be necessary for some individuals to manage multiple sets of pieces; which is to say, individuals may have multiple Representing Pieces on the Top Board that confer multiple players' worth of pieces on the Lower Board. In creating the team the game creator or the group in collaboration assign members to the available Representing Pieces. It is possible to leave some Representing Pieces unassigned and unplayed. Those pieces not played may be moved on the Top Board, and therefore the represented pieces on the Lower Board automatically moved, but on the Lower Board that set of pieces remain in static formation unless captured.

In the next configuration axis the game creator selects a game ending condition. The game ending condition sets the rule for when the game concludes. In keeping with the educational and vocational intent of the invention, the default game ending condition may be a game strategy condition, as exist in the rules of Chess, or as a negotiated event where either the Top Board players agree or one Top Board play agrees with a majority of the Lower Board players of the opposing side. Beyond the default game ending condition there exist three other options, ending at a fixed time; ending after a fixed number of rounds; or ending when one side does not or can not move within a set time.

In the next configuration the game creator selects or accepts the default game starting condition. The game starting condition determines when play opens on each board. By default the game begins with the first move of the Top Board player playing for the red (or white) team. Alternatively play may begin on the Lower Board at a given time and the Top Board players may stand by until such time as the Top Board player playing for the red (or white) team decides to move, at which point the game continues according to its turn taking and turn timing configurations.

In the turn taking configuration the game creator selects the rule that controls how turns are taken on a team and between the two teams. The default turn taking rule is that the teams trade turns first on the Top Board and then on the Lower Board from left to right. Two alternatives exist, that the Top Board turns are strictly ordered but that Lower Board turns may happen at any point during the Top Board player's turn in any order; or that all the players of a side may move one time in any order during that side's turn. In the latter two configuration options any turn on the Lower Board not taken is forfeit.

In the turn timing configuration, the game creator elects a rule that determines the pace of the game. By default all turns are limited to a set number of seconds, up to an unbounded number, chosen at the configuration time. Three alternatives exist. In one the term allotted is specified on a per-board basis, so that the Top Board players have a different time allowed than the Lower Board players have. In the next, the Top Board players are time limited but the Lower Board players are unbounded. And in the last option time is made available to the side for all turns, to be taken in whichever turn taking option selected.

In the capturing configuration the game creator specifies what the result of a piece being captured is on a Top Board or a Lower Board. There are two rules to select, applying one to the Top Board and one to the Lower Board. In the default Top Board capture rule if a piece is captured, the Lower Board player represented by that Top Board piece loses all his or her pieces and exits the game. Alternatively, if a piece is captured on the Top Board, it is removed from play, but the Lower Board player represented by the captured Top Board piece continues to take his or her turns; but his or her pieces can no longer be moved by any action of the Top Board player. By default the Lower Board capture configuration rule is that if the highest valued piece of the Lower Board player's set is captured, as happens in checkmate when playing Chess, that Lower Board player's pieces are removed from play, accounted for as captured, and that player's Top Board Representing Piece is also removed from play and accounted a capture. Alternatively, the game creator may chose the rule where when a Lower Board player's highest value piece is captured the Lower Board player's pieces are removed from play and accounted as captured; but the players Representing Piece continues to be played by the Top Board player.

In the next configuration the game creator selects the rule for how captured pieces will be valued and converted to a team score. By default the pieces are valued unequally according to the range of their possible movement, guided by the practice in Chess. Alternatively, all pieces may be valued alike, though one is still considered the highest value piece for the purposes of game ending strategy. Alternatively, the Top Board pieces may be valued more highly than Lower Board pieces; with the option to value Top Board pieces according to the number of Lower Board pieces they represent. When the game ending condition obtains, the score determines the winning side; unless the game ends due to a highest value piece capture, or by negotiation, in which cases the score, a technical win, is not the determinant of victory.

In the next configuration the game creator selects one visibility rule that determines how much information different players have about the game as a whole. The default rule allows the all players to view the current views of Lower Board players and the Top Board. Another option is that the same visibility is augmented by a view of the Lower Board showing all squares at once, but without indication of which pieces are of which types, this view is called the Overview Board. Another option is that the Top Board player may only see the Top Board, but all Lower Board players can view th Lower Board as seen by any other Lower Board player. Another option is to extend this by providing the Top Board players with access to the Overview Board. Another option is to restrict this so that the Lower Board players can only view the Lower Board as it is seen by another Lower Board player on their team. Another option restricts this further so that Lower Board players may only see their own view of the Lower Board, but may also see the Overview Board. Another option further restricts this such that the Top Board players do not have access to the Overview Board. Alternatively, the rule may be that the Top Board player may see the Top Board, the Overview Board, and any Lower Board player's view of the Lower Board. And finally, the rule may be any of those given above with the additional ability for a Lower Board player to see those Lower Board squares corresponding to any Representing Piece on the Top Board that blocks the range of motion of their Representing Piece.

The next configuration is to select a rule governing how members joining a team. By default the rule is that any potential player may join a game. An alternative is that only those individuals selected by the game creator may join the game. Another option is that only those individuals who are invited by the game creator or by another member of the team may join. Another option is that only member pre-arranged may join the team. Another alternative is for the game creator to select individuals from those who have expressed interest in joining.

The next configuration is for the game creator to select the rule for how turn taking may be delegated from one to another team member. By default the rule is that no delegation is permitted. However, due to the size of the game, its potential duration and the educational benefit of enabling delegation, the game creator may choose one of the following alternative rules. One option is any Lower Board player may delegate their turn to any individual in the total population of potential players. Another option is for Lower Board players to have available a pool of alternates, pre-selected, they may delegate to. Another option is for the Top Board player to be empowered to delegate turns on the Lower Board, or his or her own turn, as he or she sees fit. Alternatively the same rule restricted so that the Top Board player may delegate only within the pool of alternates pre-selected. Another option is for the Top Board player to be empowered to delegate turns from any individual to any individual on his or her team. Alternatively the Top Board player of the opposing team will upon request delegate from one opposing team player to the opposing team's pool of alternates, pre-selected. Alternatively the Top Board player, and subsequently their delegate, must delegate the next Top Board turn to a member of their team, with no member playing the Top Board turn a next time until all other members have been delegated the same number of Top Board turns.

In the next configuration, the game creator may elect to have certain turns skipped for a set number of rounds. The turns skipped may be assigned to players or they may be unplayed.

In the final configuration, the game creator selects the rule for how team members collaborate with each other. In the default rule, all players of both teams have access to instant messaging, email-like messaging, a signaling tool used to highlight squares on the Overview Board, called the Signaling Tool, and a means of voting on moves, for settlement, and for other decision-making, collectively called the Collaboration Tools. Alternatively, the rule may be that but restricted such that the two teams are isolated from each other. Alternatively all of the Collaboration Tools may be provided to all players, but the Top Board players may only collaborate with players on their own teams. Alternatively all of the Collaboration Tools may be used but only in one-on-one communication between a Top Board player and a Lower Board player or between the Top Board players. Alternatively, this rule may be restricted such that the Top Board players may not communicate to each other. Alternatively, this rule may be further strengthened so that in addition the Lower Board players may not communicate with the opposing Top Board player.

In addition to the collaboration rule configuration, and the use of the Collaboration Tools, the same game-integrated communications tools are also useable. under any collaboration scheme, by an outside non player educator, referred to as the Educator, who guides and provides feedback on moves. and mediation between players in order to further the learning or educational practice. To further facilitate educational use, the Collaboration Tools, including the Overview Board and images of the Top Board and views of the Lower Board, may be recorded and reviewed at the end of the game, or in the middle of the game, or replayed from a given point, at the Educator's option in order to highlight learning objectives or obstacles or results.

In view of the above, it is an object of the present invention to provide the means of creating a game playing experience which will both entertain players, and instruct them by use of analogy in the communication, collaboration, and leadership qualities that enable success in the business or military world.

Another object of the present invention is to provide sufficient flexibility in game board and piece rules of play definition to make an intentionally complex group activity less intellectually onerous to grasp for novices, especially where the game is used in a time-limited instructional setting.

Another object of the present invention is to provide sufficient flexibility in game instance definition to make a game easier to play but less instructional, or harder to play and more instructional, as well as changing the pace, duration, and other attributes of the game which may make the game play more useful as an instructive simulation, by means of the configuration of a framework for game play the components of which involve turns, timing, scoring, etc., and which in and of itself as a group activity will provide an additional platform for practicing group communication, decision making, and negotiation.

Other objects and advantages of the present invention will become apparent and obvious from a study of the following description and the accompanying drawings which are merely illustrative of such invention.

I claim:

1. A method of playing an online board game via a network server, comprising:

Forming a plurality of game boards in a hierarchical orientation wherein the plurality of game boards includes a top board and a lower board;

forming a first team and a second team via the network server, wherein each of the first and second teams includes a top board player and a plurality of lower level players;

defining a size of the top board by a first numerical value, wherein the first numerical value represents the number of rows and columns on the top board;

determining the size of the lower board as a second numerical value, wherein the second numerical value is a squared multiple of the first numerical value, such that the second numerical represents the number of rows and columns on the lower board;

positioning, via the network server, a plurality of first team top board pieces associated with the first team on the top board in an initial first team top board position;

positioning, via the network server, a plurality of second team top board pieces associated with the second team on the top board in an initial second team top board position, wherein the second team top board pieces are identical in all ways to the first team top board pieces except for a visual cue defining to which the first and second teams the first and second team top board pieces belong;

positioning, via the network server, a plurality of first team lower board piece sets on the lower board in an initial first team lower board position, wherein each of the first team lower board piece sets includes a plurality of first team lower board pieces that are identical to first team top board pieces, and wherein each first team lower board piece set is played by a first team lower board player and is represented by one of the first team top board pieces;

positioning, via the network server, a plurality of second team lower board piece sets on the lower board in an initial second team lower board position, wherein each of the second team lower board piece sets includes a plurality of second team lower board pieces that are identical to second team top board pieces, and wherein each second team lower board piece set is played by a second team lower board player and represented by one of the second team top board pieces;

moving, via player input through an online graphical user interface, a first game piece of the plurality of first team top board pieces from the initial first team top board position to a second top board position;

determining, via the network server, as an automatic part of the first team top board move, a second lower board position of the set of lower board pieces corresponding to the top board piece moved that replicates spaces moved by the top board piece such that each space moved by the top board piece causes the pieces in the corresponding set of lower board pieces to move a number of spaces equal to the width in spaces of the top board;

moving automatically, via the network server, the set of first team lower board pieces corresponding to the first team top board piece moved to the second lower board position; and displaying to the first team lower board player playing the set of first team lower board pieces corresponding to the first team top board piece moved, via the network server, a visible and playable set of spaces corresponding to the set of possible moves the first team top board player may make with the piece corresponding to the first team lower board player's set of pieces, wherein each space that the first team top board piece may move to is replicated by a number of spaces on the lower board equal to the width in spaces of the top board, and wherein the remainder of the lower board is neither visible to or playable by the first team lower board player.

* * * * *